US007760211B2

(12) United States Patent
Chang et al.

(10) Patent No.: US 7,760,211 B2
(45) Date of Patent: Jul. 20, 2010

(54) SYSTEM AND METHOD FOR LIGHT CONTROL

(75) Inventors: Chih-Kuang Chang, Tu-Cheng (TW); Wei-Qi Sun, Shenzhen (CN)

(73) Assignees: Hong Fu Jin Precision Industry (ShenZhen) Co., Ltd., Shenzhen, Guangdong Province (CN); Hon Hai Precision Industry Co., Ltd., Tu-Cheng, Taipei Hsien (TW)

( * ) Notice: Subject to any disclaimer, the term of this patent is extended or adjusted under 35 U.S.C. 154(b) by 1003 days.

(21) Appl. No.: 11/309,405

(22) Filed: Aug. 4, 2006

(65) Prior Publication Data

US 2007/0075868 A1 Apr. 5, 2007

(30) Foreign Application Priority Data

Sep. 20, 2005 (CN) ..... 2005 1 0037445

(51) Int. Cl.
*G09G 3/10* (2006.01)
*G09G 3/28* (2006.01)
*G09G 3/30* (2006.01)

(52) U.S. Cl. ..... 345/690; 345/63; 345/77

(58) Field of Classification Search ..... 345/204–215, 345/690–699, 63, 77, 89
See application file for complete search history.

(56) References Cited

U.S. PATENT DOCUMENTS 7,067,993 B2 * 6/2006 Youle ..... 315/291
2005/0200311 A1 9/2005 Youle

FOREIGN PATENT DOCUMENTS

| | | |
|---|---|---|
| TW | 275404 | 5/1996 |
| TW | 578974 | 3/2004 |
| TW | 200502722 | 1/2005 |

* cited by examiner

*Primary Examiner*—Srilakshmi K Kumar
(74) *Attorney, Agent, or Firm*—Wei Te Chung

(57) ABSTRACT

An exemplary system for light control is disclosed. The system includes a computer (1), a chip (3) which is connected with the computer via a level converting circuit (2), and a plurality of light luminance control circuits. Each light luminance control circuit controls a corresponding light circuit. A related method is also disclosed. The method includes the steps of: initializing parameters for a communication serial port of a computer and a chip; receiving light luminance information, and outputting the light luminance information to the chip; processing the received light luminance information, and sending a light luminance control signal to each light luminance control circuit; converting the received light luminance control signal; and controlling light of each light circuit.

10 Claims, 2 Drawing Sheets

SYSTEM AND METHOD FOR LIGHT CONTROL

FIELD OF THE INVENTION

The present invention relates to systems and methods for control, and more particularly to a system and method for light control.

DESCRIPTION OF RELATED ART

Light control plays an important role in the field of measurements, this is because the effect of light has a strong impact on measuring precision. Therefore, there are quite a few requirements for light control. Firstly, a luminance of a light source must be kept stable and must further possess a wide range of adjustability. Secondly, an enabling or a disabling of a single light source among many should be simultaneously controllable with no interaction effect. Thirdly, it is preferred to utilize software for light control so as to achieve a high control speed. However, the existing light control devices are sub-par and inefficiency, such as having an unstable luminance adjustment, a slow response speed, a quick current change, and so on.

Therefore, what is needed is a system and method for light control that has a high response speed and an stable luminance adjustment.

SUMMARY OF INVENTION

One embodiment provides a system for light control. The system includes a plurality of light luminance control circuits and a plurality of light circuits. Each light luminance control circuit controls a corresponding light circuit. The system also includes a computer and a chip connected with the computer via a level converting circuit. The computer is configured for receiving and outputting light luminance information set by users, and the chip is configured for receiving the light luminance information outputted by the computer, converting the light luminance information into a light luminance control voltage signal, and sending the light luminance control voltage signal to each light luminance control circuit to control light of a corresponding light circuit.

Another embodiment provides a method for light control. The method includes the steps of: (a) initializing parameters for a communication serial port of a computer and a chip, the chip being connected with the computer via a level conversion circuit; (b) receiving light luminance information with the computer, and sending the light luminance information to the chip; (c) processing the light luminance information by the chip to obtain a light luminance control voltage signal; (d) sending the light luminance control voltage signal to a light luminance control circuit; (e) converting the light luminance control voltage signal into an adjustable pulse width rectangular wave control voltage signal; and (f) controlling light of a corresponding light circuit by using the rectangular wave control voltage signal.

Other objects, advantages and novel features of the embodiments will be drawn from the following detailed description together with the attached drawings, in which:

DETAILED DESCRIPTION

Figure 1:
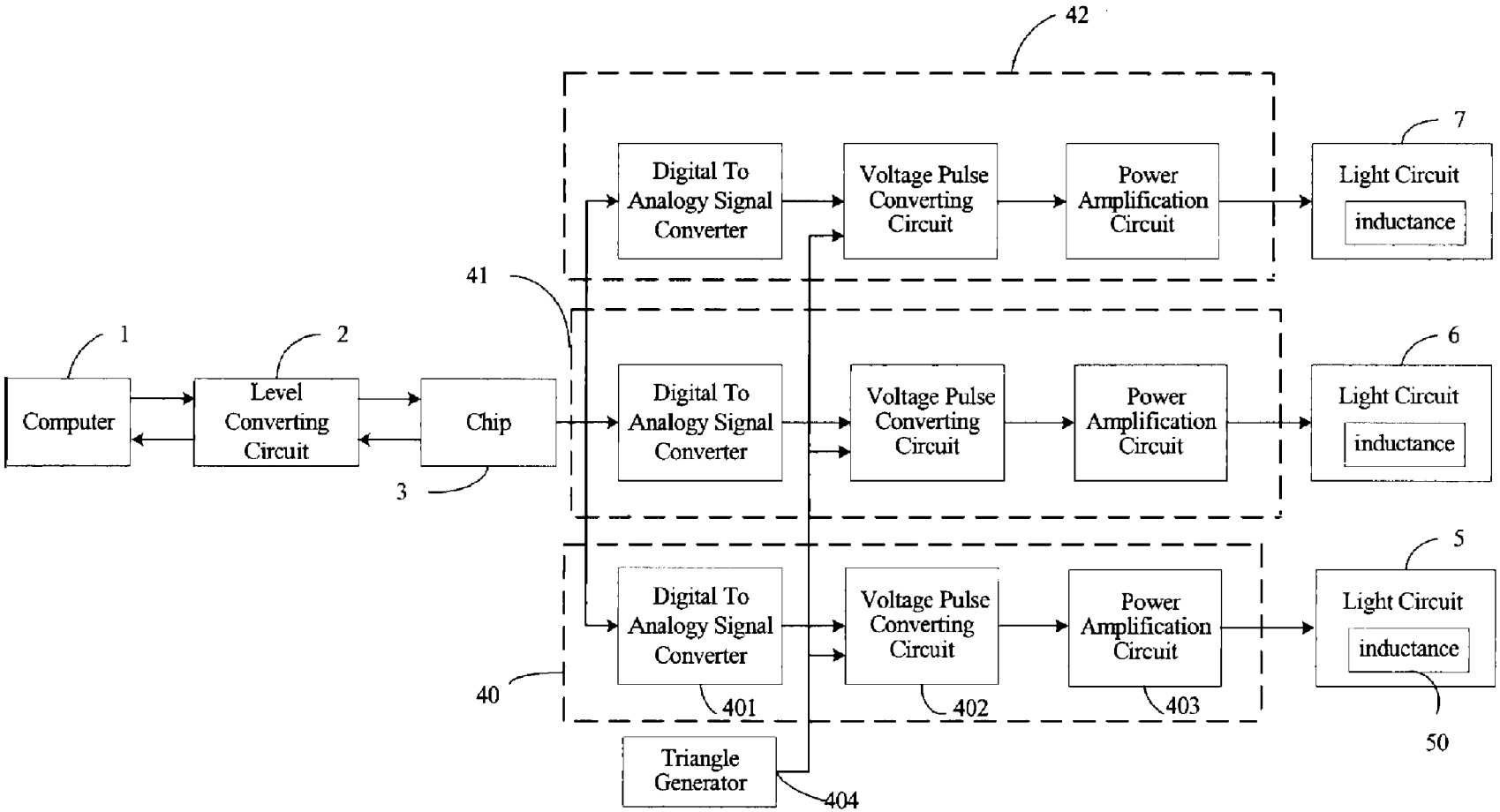
FIG. 1 is a schematic diagram of a hardware configuration of a system for light control in accordance with a preferred embodiment.

FIG. 1 is a schematic diagram of a hardware configuration of a system for light control in accordance with a preferred embodiment. The system typically includes a computer 1, a chip 3 that is connected with the computer 1 via a level converting circuit 2, a plurality of light luminance control circuits (only three shown, i.e. 40, 41, 42), and a plurality of light circuits (only three shown, i.e. 5, 6, 7). Each light luminance control circuit controls a corresponding light circuit.

The computer 1 is configured for providing a user interface to receive light luminance information. The light luminance information is a negative logic level signal. The level converting circuit 2 is configured between the computer 1 and the chip 3 for receiving and converting the negative logic level signal outputted by the computer 1 into a positive logic level signal, and for sending the positive logic level signal to a communication serial port of the chip 3. The chip 3 is configured for receiving and converting the positive logic level signal sent by the level converting circuit 2 into a light luminance control voltage signal. The light luminance control voltage signal may be a digital signal. In order for the computer 1 to verify whether the information sent initially is correct, the chip 3 can further send a feedback state of the positive logic level signal to the computer 1 via the level converting circuit 2 when the chip 3 receives the positive logic level signal. If there are any data discrepancies between the negative logic level signal outputted by the computer 1 and the feedback state, the computer 1 may prompt errors via user interface. For a better communication between the computer 1 and the chip 3, communication serial port parameters of the computer 1 and the chip 3 are initialized. The parameters may include a serial port number, a baud rate, a data bit, and so on.

The light luminance control circuits 40, 41, and 42 respectively control light circuits 5, 6, and 7. The three groups of light luminance control circuits 40, 41, and 42 share a common triangle generator 404 that is configured for generating a triangle carrier wave voltage signal for each light luminance control circuit. In the preferred embodiment, the light luminance control circuit 40 that controls the light circuit 5, similar to the light luminance control circuits 41 and 42 which respectively control the light circuits 6 and 7, is exemplary and described in detail.

The light luminance control circuit 40 consists of a digital to analog signal converter 401, a voltage pulse converting circuit 402, and a power amplification circuit 403 serially connected in that order. An input terminal of the voltage pulse converting circuit 402 is connected with the triangle generator 404 to receive the triangle carrier wave voltage signals generated by the triangle generator 404.

The digital to analog signal converter 401 is configured for receiving and converting the light luminance control voltage signal sent by the chip 3 into an adjustable control voltage analog signal. The adjustable control voltage analog signal and the triangle carrier wave voltage signal are two input signals of the voltage pulse converting circuit 402. By comparing the two input signals, the voltage pulse converting circuit 402 generates an adjustable pulse width rectangular wave control voltage signal, and sends it to the power amplification circuit 403. The power amplification circuit 403 is configured for amplifying the adjustable pulse width rectangular wave control voltage signal, and using the amplified adjustable pulse width rectangular wave control voltage signal to control the light circuit 5. The power amplification circuit 403 includes a dynatron that can amplify the adjustable pulse width rectangular wave control voltage signal, and can further act as an enabling and disabling switch element. In addition, there is an inductance 50 designed in the light circuit 5. The inductance 50 is chosen to hinder the current in the light circuit 5 from changing quickly to maintain stability of the light circuit 5.

Figure 2:
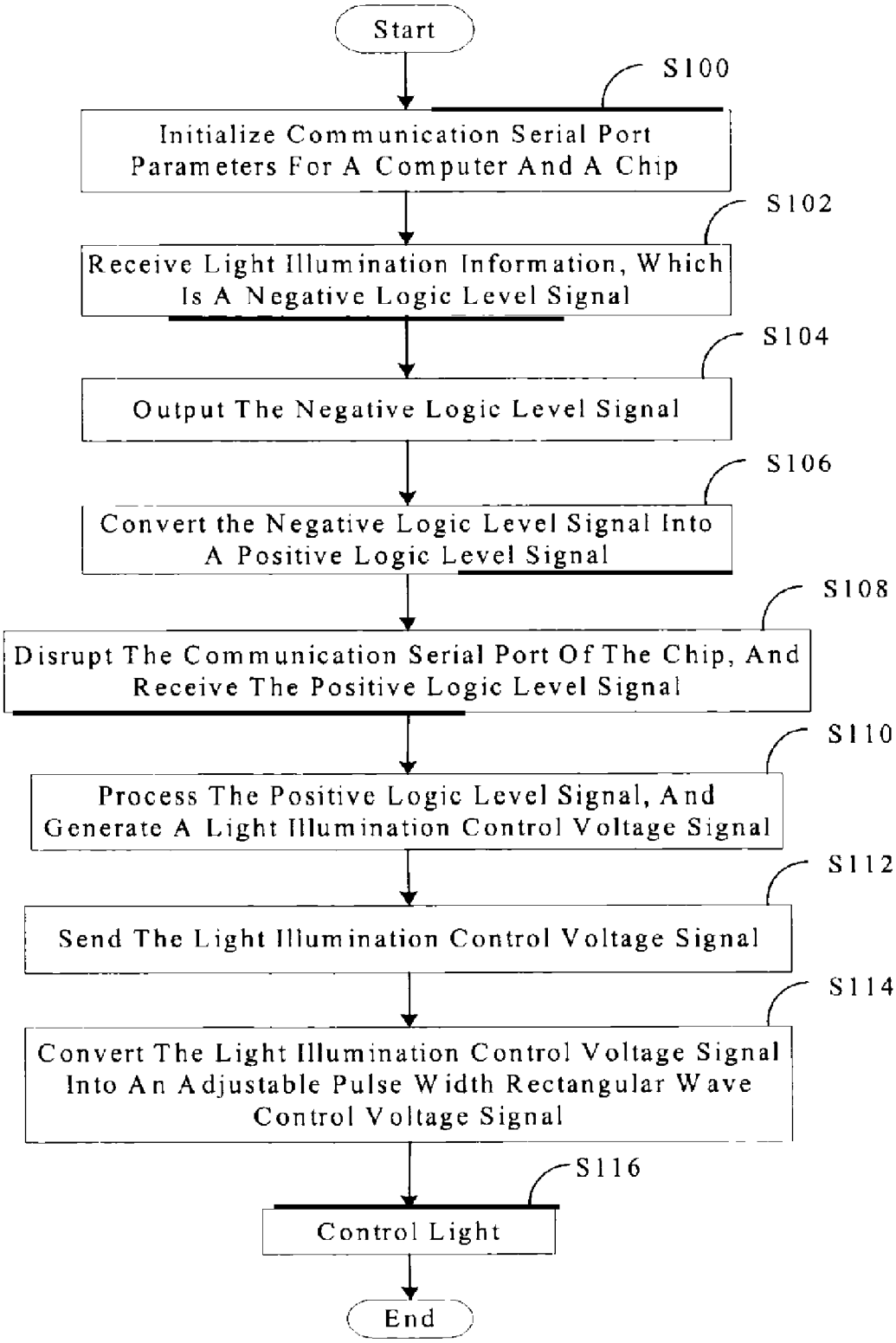
FIG. 2 is a flow chart of a preferred method for light control by utilizing the system of FIG. 1.

FIG. 2 is a flow chart of a preferred method for the light control by utilizing the system of FIG. 1. In step S100, parameters for a communication serial port of the computer 1 and the chip 3 are initialized. The parameters include a serial port number, a baud rate, a data bit, and so on. In step S102, the computer 1 receives light luminance information. The light luminance information is a negative logic level signal. In step S104, the computer 1 outputs the negative logic level signal to the level converting circuit 2 via the communication serial port. In step S106, the level converting circuit 2 converts the negative logic level signal received into a positive logic level signal receivable by the chip 3. In step S108, the positive logic level signal triggers off and disrupts the communication serial port of the chip 3 in order for the chip 3 to receive the positive logic level signal outputted by the level converting circuit 2. In this step, the chip 3 sends a feedback state of the positive logic level signal to the computer 1 via the level converting circuit 2 so that the computer 1 can verify whether the information sent initially is correct. If there are any data discrepancies between the negative logic level signal outputted by the computer 1 and the feedback state, the computer 1 may prompt errors via user interface.

In step S110, the chip 3 processes the positive logic level signal. The chip 3 can be a Microprogrammed Control Unit (MCU). Specifically as follows: the chip 3 has a built in memory that stores light luminance information by different ranks; the chip 3 decodes the positive logical level signal received into an address in the built in memory corresponding the rank of the light luminance information, after acquiring the light luminance information according to the address the chip 3 converts the light luminance information into a light luminance control voltage signal. In step S112, the chip 3 sends the light luminance control voltage signal to the light luminance control circuit 40. The light luminance control voltage signal is a digital signal. In step S114, the light luminance control circuit 40 converts the light luminance control voltage signal sent by the chip 3 into an adjustable pulse width rectangular wave control voltage signal. Specifically as follows: the digital to analog signal converter 401 receives and converts the light luminance control voltage signal sent by the chip 3 into an adjustable control voltage analog signal; the digital to analog signal converter 401 then sends the adjustable control voltage analog signal together with the triangle carrier wave voltage signal generated by the triangle generator 404 to the two input terminals of the voltage pulse converting circuit 402 as two input signals; by comparing the two input signals, the voltage pulse converting circuit 402 generates an adjustable pulse width rectangular wave control voltage signal, and sends it to the power amplification circuit 403 to be amplified. In step S116, the amplified adjustable pulse width rectangular wave control voltage signal controls the dynatron in the light circuit 5 enabling and disabling, in order to control light of the light circuit 5 correspondingly.

It should be emphasized that the above-described embodiments of the present invention, particularly, any "preferred" embodiments, are merely possible examples of implementations, merely set forth for a clear understanding of the principles of the invention. Many variations and modifications may be made to the above-described embodiment(s) of the invention without departing substantially from the spirit and principles of the invention. All such modifications and variations are intended to be included herein within the scope of this disclosure and the present invention and protected by the following claims.

What is claimed is:

1. A system for light control, the system comprising:

a computer configured for receiving light luminance information; and a chip connected with the computer via a level converting circuit, the level converting circuit configured for receiving the light luminance information outputted by the computer, and for converting the light luminance information into a light luminance control voltage signal; and a plurality of light luminance control circuits, each of the light luminance control circuits being connected with a triangle wave generator for generating a triangle carrier wave voltage signal, configured for receiving the light luminance control voltage signal from the chip, generating an adjustable pulse width rectangular wave control voltage signal according to the light luminance control voltage signal and the triangle carrier wave voltage signal, and controlling light of a light circuit according to the adjustable pulse width rectangular wave control voltage signal.

2. The system according to claim 1, wherein the light luminance information outputted by the computer is a negative logical level signal that is converted into a positive logical level signal receivable by the chip.

3. The system according to claim 1, wherein each of the light luminance control circuits comprises a digital to analog signal converter, a voltage pulse converting circuit, and a power amplification circuit in series.

4. The system according to claim 3, wherein the triangle generator is connected with each of the plurality of light luminance control circuits via one input terminal of the voltage pulse converting circuit.

5. The system according to claim 1, wherein the light circuit comprises an inductance designed for hindering a quick current change.

6. A method for light control, the method comprising steps of:

initializing parameters for a communication serial port of a computer and a chip, the chip being connected with the computer via a level converting circuit;

receiving light luminance information from the computer, and sending the light luminance information to the chip;

processing the light luminance information by the chip to obtain a light luminance control voltage signal;

sending the light luminance control voltage signal to each a plurality of light luminance control circuits;

generating a triangle carrier wave voltage signal using a triangle wave generator connected to each of the light luminance control circuits, and sending the triangle carrier wave voltage signal to each of the light luminance control circuits;

generating an adjustable pulse width rectangular wave control voltage signal according to the light luminance control voltage signal and the triangle carrier wave voltage signal; and controlling light of a light circuit by using the adjustable pulse width rectangular wave control voltage signal.

7. The method according to claim 6, wherein the parameters of the communication serial port comprise a serial port number, a baud rate, and a data bit.

8. The method according to claim 6, wherein the light luminance information sent by the computer is a negative logical level signal that is converted into a positive logical level signal receivable by the chip.

9. The method according to claim 6, wherein the step of processing the light luminance information comprises steps of:

converting the light luminance information into an address in a built in memory of the chip corresponding to the rank of the light luminance information in the built; and acquiring the light luminance information according to the address, and converting the light luminance information into the light luminance control voltage signal.

10. The method according to claim 6, wherein the step of generating an adjustable pulse width rectangular wave control voltage signal comprises steps of:

converting the light luminance control voltage signal sent by the chip into an adjustable control voltage analog signal;

sending the adjustable control voltage analog signal together with the triangle carrier wave voltage signal generated by the triangle wave generator to a voltage pulse converting circuit as two input signals;

generating the adjustable pulse width rectangular wave control voltage signal by comparing the two input signals of the voltage pulse converting circuit; and sending the rectangular wave control voltage signal to a power amplification circuit to be amplified.

* * * * *